US008225773B2

(12) United States Patent
Gruner et al.

(10) Patent No.: US 8,225,773 B2
(45) Date of Patent: Jul. 24, 2012

(54) VALVE ARRANGEMENT FOR AN EXHAUST GAS RECIRCULATION DEVICE

(75) Inventors: Andreas Gruner, Hattenhofen (DE); Robert Sendor, Wolfratshausen (DE); Rudiger Knauss, Kernen I.r. (DE); Bernhard Schwalk, Stuttgart (DE)

(73) Assignee: Mahle International GmbH (DE)

( * ) Notice: Subject to any disclaimer, the term of this patent is extended or adjusted under 35 U.S.C. 154(b) by 517 days.

(21) Appl. No.: 12/301,368

(22) PCT Filed: May 9, 2007

(86) PCT No.: PCT/EP2007/054460

§ 371 (c)(1),
(2), (4) Date: Dec. 23, 2009

(87) PCT Pub. No.: WO2007/134962

PCT Pub. Date: Nov. 29, 2007

(65) Prior Publication Data

US 2010/0108041 A1 May 6, 2010

(30) Foreign Application Priority Data

May 19, 2006 (DE) ..... 10 2006 023 852

(51) Int. Cl.
*F02B 47/08* (2006.01)

(52) U.S. Cl. ..... 123/568.12; 123/568.2

(58) Field of Classification Search ..... 123/41.4, 123/568.12, 568.18, 568.2, 568.21, 568.23, 123/568.24
See application file for complete search history.

(56) References Cited

U.S. PATENT DOCUMENTS

| | | | | |
|---|---|---|---|---|
| 4,020,809 | A * | 5/1977 | Kern et al. | 123/568.24 |
| 4,267,812 | A | 5/1981 | Aula et al. | |
| 5,617,726 | A | 4/1997 | Sheridan et al. | |
| 5,732,688 | A | 3/1998 | Charlton et al. | |
| 6,014,960 | A * | 1/2000 | Oleksiewicz | 123/568.2 |
| 6,584,767 | B1 * | 7/2003 | Koenig | 60/288 |
| 7,121,088 | B2 * | 10/2006 | Lavin | 60/324 |

(Continued)

FOREIGN PATENT DOCUMENTS

DE 19831140 1/2000

(Continued)

OTHER PUBLICATIONS

English abstract provided for EP-1275838.

(Continued)

*Primary Examiner* — Hai Huynh
(74) *Attorney, Agent, or Firm* — Rader, Fishman & Grauer PLLC

(57) ABSTRACT

The invention relates to a valve arrangement (2) for an exhaust gas recirculation device of an internal combustion engine, especially in a motor vehicle. Said valve arrangement (2) comprises a first valve (9) which is used to control a first gas path (7) and is mobile between an open position, a closed position, and at least one intermediate position. The inventive valve arrangement (2) also comprises a second valve (10) for controlling a second gas path (8) which is separate from the first gas path (7), said second valve being mobile between an open position, a closed position and at least one intermediate position independently from the first valve (9). The valve arrangement (2) also comprises a common housing (6) which contains both valves (9, 10) and through which the two gas paths (7, 8) are guided.

20 Claims, 4 Drawing Sheets

U.S. PATENT DOCUMENTS

Figure 1:
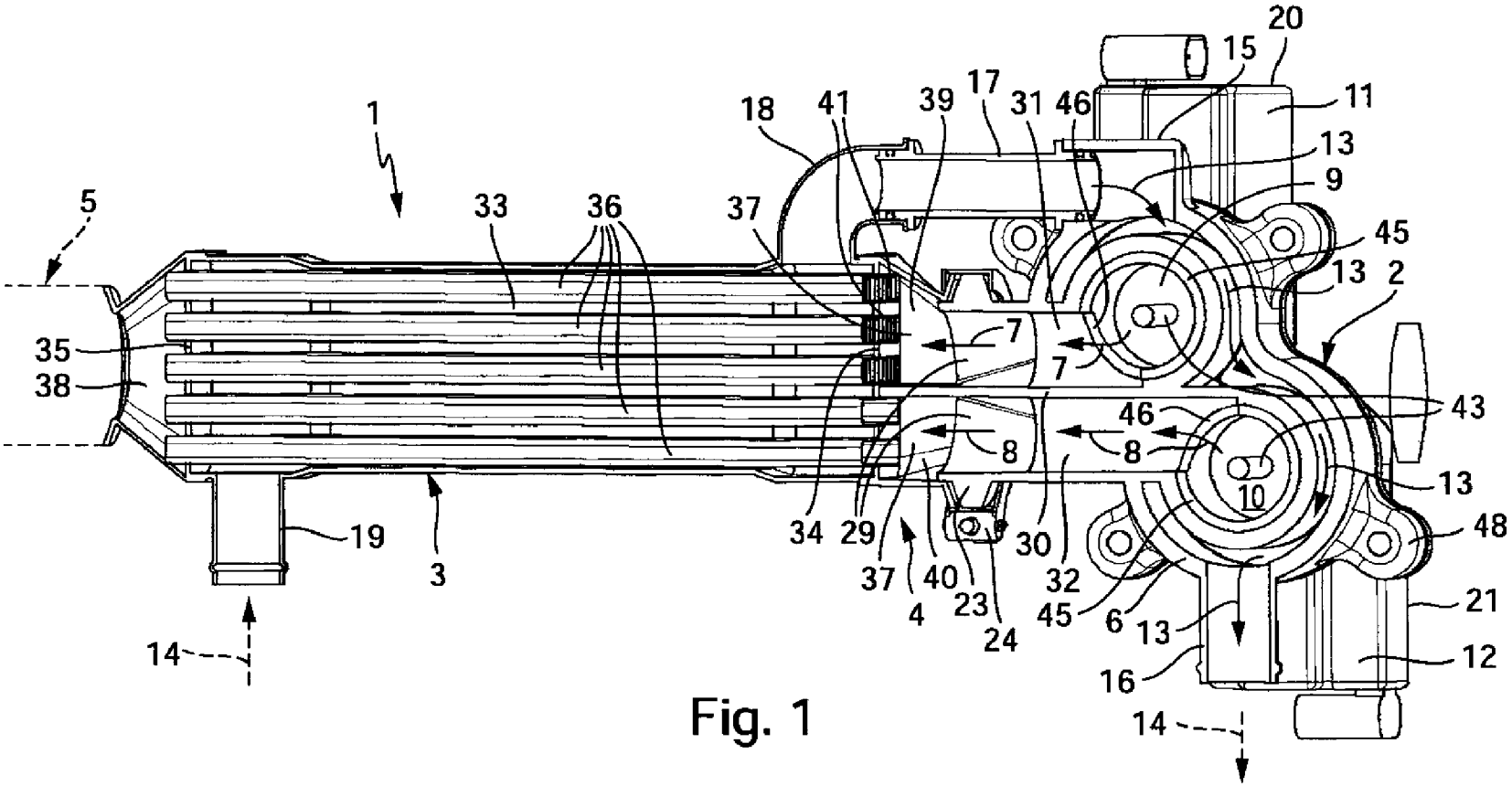

| | | | | |
|---|---|---|---|---|
| 7,814,748 | B2 * | 10/2010 | Nydam et al. | 60/324 |
| 7,845,338 | B2 * | 12/2010 | Smith et al. | 123/568.12 |
| 7,900,609 | B2 * | 3/2011 | Modien et al. | 123/568.12 |
| 7,987,837 | B2 * | 8/2011 | Lupescu et al. | 123/568.2 |
| 2003/0168111 | A1 | 9/2003 | Koga et al. | |

FOREIGN PATENT DOCUMENTS

| | | |
|---|---|---|
| DE | 19962863 | 6/2001 |
| DE | 69720661 | 10/2003 |
| DE | 102004010117 | 11/2004 |
| DE | 10344217 | 4/2005 |
| DE | 10344218 | 4/2005 |
| EP | 1275838 | 1/2003 |
| EP | 1342908 | 9/2003 |
| WO | WO-9630635 | 10/1996 |
| WO | WO-0144651 | 6/2001 |

OTHER PUBLICATIONS

English abstract provided for DE-10344218.
English abstract provided for EP-1342908.
English abstract provided for DE-19962863.
English abstract provided for DE-19831140.

* cited by examiner

VALVE ARRANGEMENT FOR AN EXHAUST GAS RECIRCULATION DEVICE

CROSS-REFERENCES TO RELATED APPLICATION

This application is a National Stage application which claims the benefit of International Application No. PCT/EP2007/054460 filed May 9, 2007, which claims priority based on German Patent Application No. DE 10 2006 023852.4, filed May 19, 2006, both of which are hereby incorporated by reference in their entirety.

The present invention relates to a valve arrangement for an exhaust gas recirculation device of an internal combustion engine, especially in a motor vehicle. The invention relates furthermore to an exhaust gas recirculation device equipped with such a valve arrangement.

In internal combustion engines, an exhaust gas recirculation is increasingly used to thereby improve the emission values and the efficiency of the internal combustion engine. To avoid here an increase of $NO_x$ emissions, it is necessary to cool the recirculated exhaust gases by means of an exhaust gas recirculation cooler, abbr. EGR cooler, since the $NO_x$ generation in the combustion process increases disproportionately high with increasing temperature.

Accordingly, an exhaust gas recirculation device, abbr. EGR device, of the type mentioned above, comprises typically an EGR cooler which is built into an exhaust gas recirculation line, abbr. EGR line, and which is connected to a cooling circuit operating with liquid coolant.

From WO 96/30635 A1, an EGR device is known, which comprises a bypass externally bypassing the EGR cooler, and which is controllable by means of a respective switching valve. By means of such a bypass, the possibility is provided to bypass the EGR cooler with an activated bypass. This is desired, for example, for a cold start of the internal combustion engine to heat up the internal combustion engine as quickly as possible by means of the heat of the recirculated exhaust gases. With a hot internal combustion engine, the bypass is deactivated so that the recirculated exhaust gases then flow through the EGR cooler, thereby being cooled.

From DE 199 62 863 A1, another EGR device comprising an EGR cooler and a bypass is known, whereby the bypass bypasses the EGR cooler internally. For this, the bypass runs within the cooler housing but is thermally insulated with respect to the coolant. For controlling of the exhaust gas flow through the bypass or the cooler, respectively, in the outlet side of the housing of the known EGR cooler, a flap-like controlling element is integrated, which, in the one end position, blocks the bypass and opens the cooler, in the other end position, blocks the cooler and opens the bypass, and in intermediate positions, allows any distribution of the exhaust gas flow between the bypass and the cooler.

The present invention is concerned with the problem to propose, for an EGR device, a cost effective way to adjust the amount and the temperature of the recirculated exhaust gases as accurate as possible.

This problem is solved according to the invention by the subject matters of the independent claims. Advantageous embodiments are subject matter of the dependent claims.

The invention is based on the general idea to provide, for an EGR device, a valve arrangement, which includes in a common housing, two separate gas paths and two valves for controlling these gas paths, wherein each of the two valves can be switched between an open position, a closed position, and at least one intermediate position. By means of the separate controllability of the two valves, any distribution of the recirculated exhaust gases to the two gas paths can be achieved. Thereby, for example, any mixture ratio of a flow guided through a cooler and through a bypass can be adjusted. Furthermore, the intermediate positions of the two valves allow a quantity regulation of the recirculated gases. Consequently, the amount of the recirculated exhaust gases, which is also called exhaust gas recirculation rate, or abbr. EGR rate, can be adjusted. Hereby, an additional valve for adjusting the EGR rate can be omitted. Thereby, the valve arrangement can be built comparatively cost effective.

In an advantageous embodiment, the common housing can be formed such that it can be connected to a coolant circuit. The cooling of the housing allows the arrangement of the valve arrangement upstream or on the inlet side of the EGR cooler, which is advantageous for the accurate adjustment of the EGR rate and the cooling effect. Furthermore, the cooled housing allows the use of plastic as material for the components of the valve arrangement which are mounted to the housing. Thereby, for example, the housings of actuator drives for the actuation of the valves can be made of plastic.

Further important features and advantages of the invention are apparent from the sub-claims, the drawings, and the associated description of the figures by means of the drawings.

It is to be understood that the aforementioned and the following features still to be illustrated are not only usable in the respective mentioned combination, but also in other combinations or on its own, without departing from the scope of the present invention.

Preferred exemplary embodiments of the invention are illustrated in the drawings, and are explained in the following description in more detail, wherein identical reference numbers refer to identical, or similar, or functionally identical components.

In the figures

Figure 2:
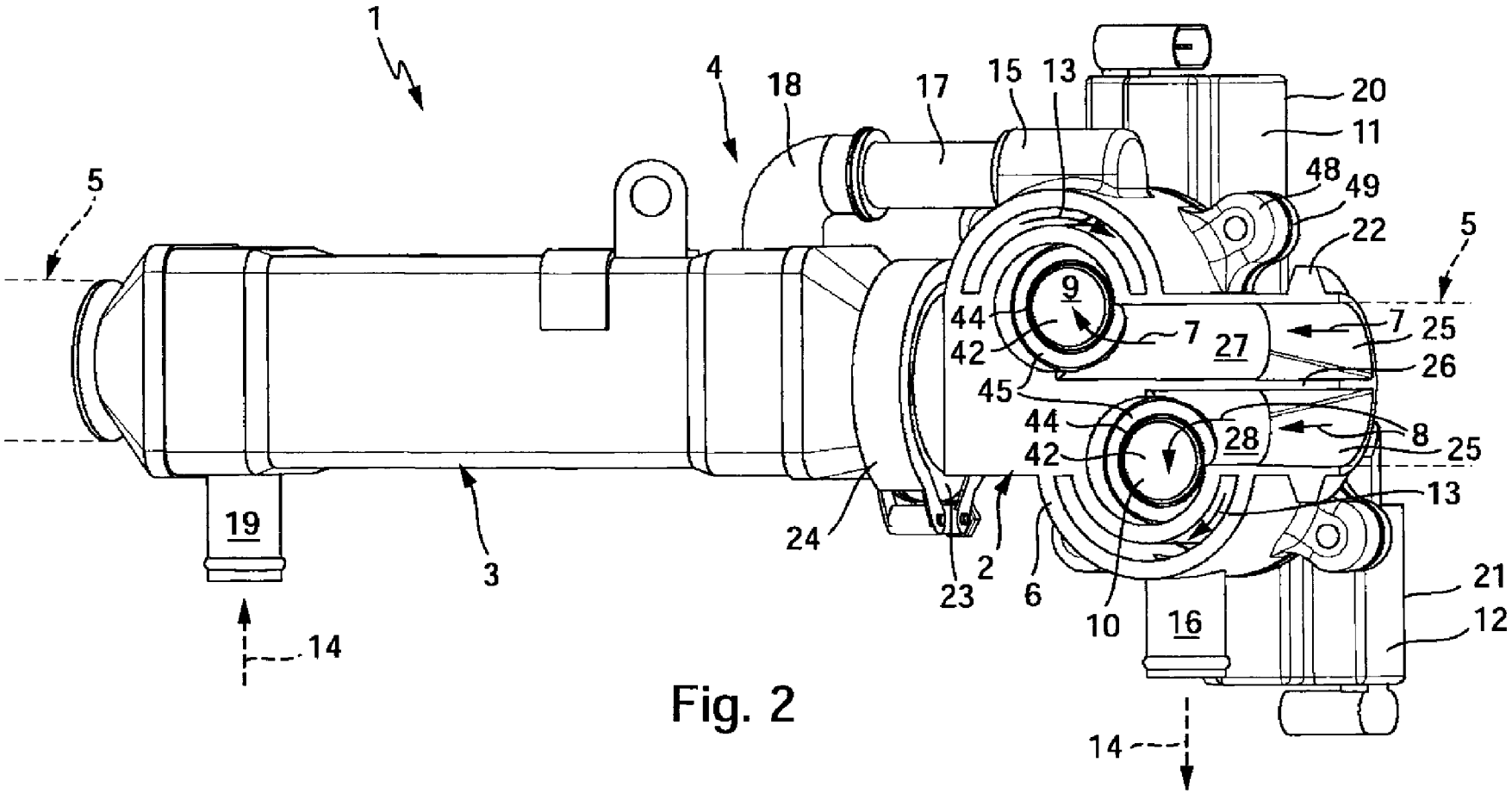
Figure 3:
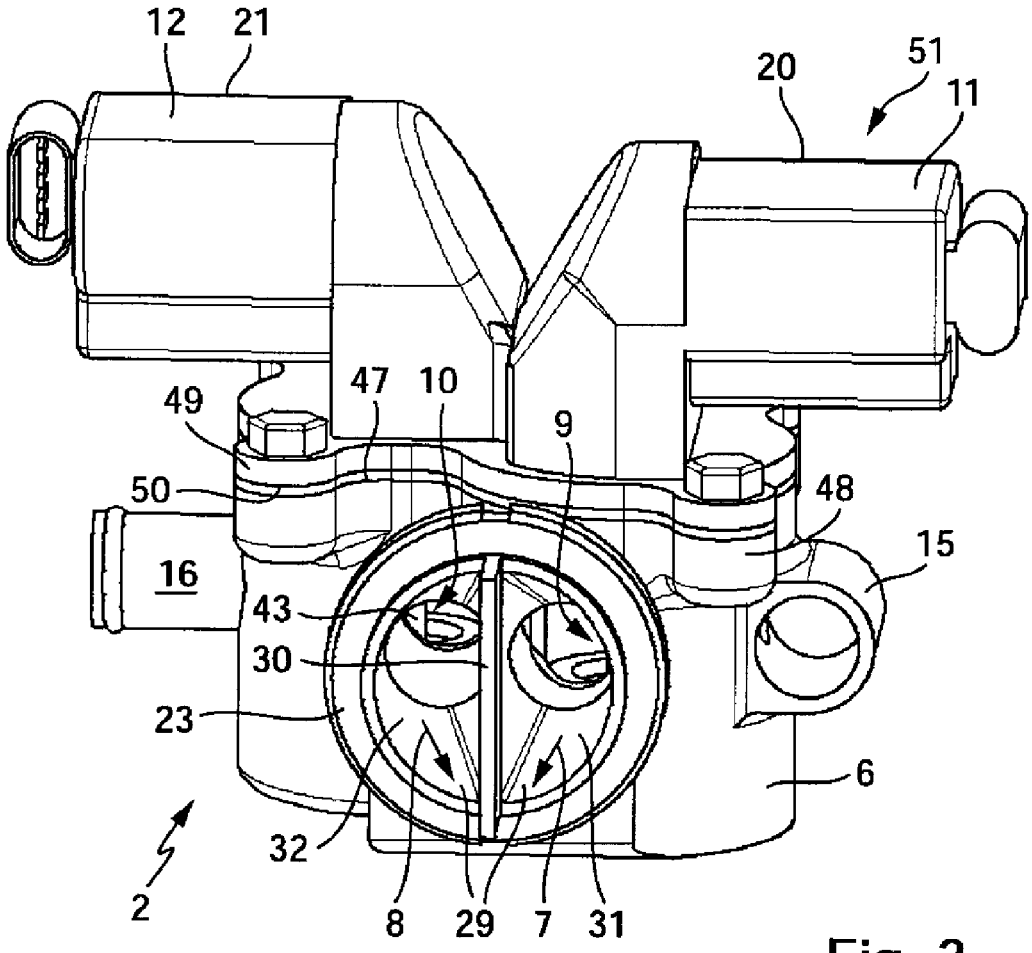
Figure 4:
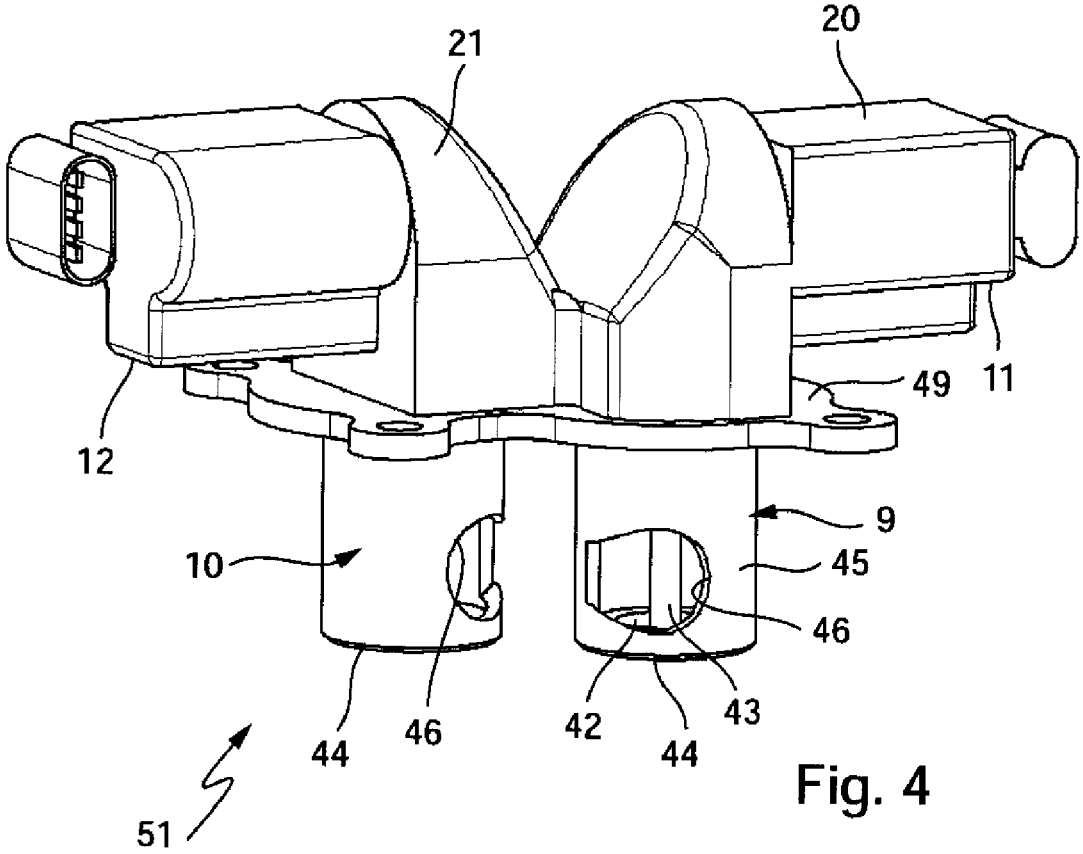

FIG. 1 shows schematically a longitudinal section through a valve arrangement with an exhaust gas recirculation cooler mounted thereon, FIG. 2 shows schematically a longitudinal section as in FIG. 1, but in a different section plane, FIG. 3 shows schematically a perspective view on the valve arrangement, FIG. 4 shows a view as in FIG. 3, but with omitted housing.

According to FIGS. 1 and 2, an only partially illustrated exhaust gas recirculation device 1, hereinafter EGR device 1, comprises a valve arrangement 2 and an exhaust gas recirculation cooler 3, hereinafter EGR cooler 3. Preferably, the valve arrangement 2 is directly connected to the EGR cooler 3, whereby the valve arrangement 2 and the EGR cooler 3 form an assembly 4, which can be preassembled, which is easy to handle and simplifies the installation into an exhaust gas recirculation line 5, hereinafter EGR line 5, which is indicated here only by broken lines. The EGR device 1 serves in a typical manner in an internal combustion engine, which is not shown here, and which can be arranged in particular in a motor vehicle, for recirculating exhaust gases of the internal combustion engine from an exhaust gas side to a fresh gas side of the internal combustion engine. For this, the EGR line 5 is connected, on the one hand, to the exhaust gas side, and, on the other hand, to the fresh gas side of the internal combustion engine, and includes the valve arrangement 2 and the EGR cooler 3.

According to FIGS. 1 to 4, the valve arrangement 2 comprises a common housing 6, in which two gas paths are formed, which are more or less separated from each other, namely a first gas path 7 and a second gas path 8, which are both indicated here by arrows. The valve arrangement 2 comprises in addition two valves, namely a first valve 9 and a second valve 10, each of them arranged in the housing 6. The first valve 9 is dedicated to the first gas path 7 and can hence control a gas flow through the first gas path 7. In contrast to that, the second valve 10 is dedicated to the second gas path 8 and thus can control a gas flow through the second gas path 8. Both valves 9, 10 are mobile independently from each other between an open position, a closed position, and at least one intermediate position. For this, the valve arrangement 2 comprises for each valve 9, 10, an actuator drive, namely a first actuator drive 11 for actuation of the first valve 9, and a second actuator drive 12 for actuation of the second valve 10.

The common housing 6 includes, in addition to the two gas paths 7, 8, a coolant path 13, which is also indicated here by arrows. The coolant path 13 can be connected to a cooling circuit 14, which is indicated here by arrows drawn with broken lines. For connection to the cooling circuit 14, the housing 6 comprises an inlet port 15 and an outlet port 16, which are both connected with the coolant path 13.

In the shown example, the inlet port 15 is connected to a coolant outlet 18 of the EGR cooler 3 via a connection piece 17. For this, a coolant inlet 19 of the EGR cooler 3 is connected to the cooling circuit 14 so that the coolant of the cooling circuit 14 enters into the assembly 4 via the coolant inlet 19 of the EGR cooler 3 and exits the assembly 4 again via the outlet port 16 of the housing 6. Hereby, a particularly compact construction for the assembly 4 is achieved.

The housing 6 is preferably made of metal. It can preferably be made from one piece. The housing 6 is, for example, a casting.

By means of the cooled housing 6, it is possible to arrange the valve arrangement 2 upstream of the EGR cooler 3 with respect to the exhaust gas flow. Furthermore, the cooled housing 6 allows the use of plastic for components of the valve arrangement 2, which are to be mounted onto the housing 6. This concerns, for example, a first drive housing 20 of the first actuator drive 11, and a second drive housing 21 of the second actuator drive 12. Both drive housings 20, 21 can be made cost effectively from plastic and can still be attached to the housing 6, even though the same hot exhaust gases flow through during the operation of the EGR device 1.

According to FIG. 2, the housing 6 comprises an inlet flange 22, by means of which the housing 6 can be integrated into EGR device 1. In the shown installation case, the housing 6 is connected to the EGR line 5 via the inlet flange 22. According to the FIGS. 1 to 3, the housing 6 comprises in addition an outlet flange 23, by means of which the housing 6 can be integrated into the EGR device 1. In the shown example, the housing 6 is connected directly to the EGR cooler 3 via the outlet flange 23. A mounting element, here a clamp, is denoted with 24. Each of the two gas paths 7, 8 now extend within the housing 6 from the inlet flange 22 up to the outlet flange 23.

According to FIG. 2, the housing 6 can be provided with an inlet line 25, which runs from the inlet flange 22 up to the inlet sides, which are not described in more detail, of the valves 9, 10. In the preferred embodiment shown here, the housing 6 includes in addition an inlet partition 26. This inlet partition 26 is arranged in the inlet line 25 such that two separate inlet channels are formed therein, namely a first inlet channel 27 and a second inlet channel 28. In the example, the inlet partition 26 is dimensioned such that it extends into the inlet flange 22 and is flush with the same. The first inlet channel 27 hence connects the inlet flange 22 with the inlet side of the first valve 9, while the second inlet channel 28 connects the inlet flange 22 with the inlet side of the second valve 10. The inlet partition 26 is preferably an integral portion of the housing 6. In the configuration shown here, in which the valve arrangement 2 is arranged upstream of the EGR cooler 3 with respect to the exhaust gas flow, the inlet partition 26 can basically be omitted.

According to FIGS. 1 and 3, the housing 6 comprises an outlet line 29, which extends from the outlet flange 23 up the outlet sides, which are not described in more detail, of the valves 9, 10. Furthermore, in the housing 6, an outlet partition 30 is formed. The same is arranged in the outlet line 29 such that it forms therein two separate outlet channels, namely a first outlet channel 31 and a second outlet channel 32. Furthermore, the outlet partition 30 is dimensioned here such that it projects axially beyond the outlet flange 23. The first outlet channel 31 connects the outlet side of the first valve 9 with the outlet flange 23. The second outlet channel 32 connects the outlet side of the second valve 10 with the outlet flange 23. The outlet partition 30 is preferably an integral portion of the housing 6.

The EGR cooler 3 includes a cooling chamber 33, through which coolant can flow, and which is connected to the coolant inlet 19 and the coolant outlet 18, and which is bounded on an exhaust gas inlet side by an inlet wall 34, and on an exhaust gas outlet side by an outlet wall 35. The cooling room 33 is penetrated by a plurality of cooling tubes 36, which, on the one hand, penetrate through the inlet wall 34, and, on the other hand, penetrate through the outlet wall 35. Here, the cooling tubes 36 communicate on the exhaust gas side with an inlet chamber 37 of the EGR cooler 3, and on the exhaust gas outlet side with an outlet chamber 38. The outlet partition 30 of the housing 6 is preferably dimensioned such that it projects in the assembled state of the assembly 4 so far into the inlet chamber 37 that it extends up to the inlet wall 34. In doing so, the outlet partition 30 can touch the inlet wall 34 or can maintain a comparatively small gap thereto. In any case, the outlet partition 30 separates two inlet sub-chambers in the inlet chamber 37 from each other, namely a first inlet sub-chamber 39 communicating with the first outlet channel 31, and a second inlet sub-chamber 40 communicating with the second outlet channel 32. The inlet sub-chambers 39, 40 communicate independent from each other via the cooling tubes 36 with the outlet chamber 38. Hereby it is possible to guide the exhaust gas flow, by means of corresponding actuations of the valves 9, 10, exclusively through the cooling tubes 36 of the first inlet sub-chamber 39, or exclusively through the cooling tubes 36 of the second inlet sub-chamber 40, or in any distribution ratio through the cooling tubes 36 of the two inlet sub-chambers 39, 40. Particularly interesting is such an embodiment in the case when, by means of an appropriate design of the EGR cooler 3, the flow-through of the cooling tubes 36, which branch off from the one inlet sub-chamber 39, results in a different cooling effect for the exhaust gases than the flow-through of the cooling tubes 36, which branch off from the other inlet sub-chamber 40. For example, the cooling tubes 36, dedicated here to the first inlet sub-chamber 39, can be equipped with turbulators and/or ribs 41, which, during the flow-through of the respective cooling tube 36, on the one hand, increase the heating flow between the exhaust gas and the cooling tube 36, and thereby, on the other hand, between the cooling tube 36 and the coolant.

In the preferred embodiment shown here, the valve arrangement 2 is hence used to distribute the recirculated exhaust gas flow to two cooling tube groups cooling with different cooling power. In a different embodiment, the valve arrangement 2 can also be used to distribute the recirculated exhaust gas flow between an EGR cooler and an internal or external bypass bypassing the EGR cooler.

In the embodiment shown, the valve arrangement 2 is arranged upstream of the EGR cooler 3 with respect to the exhaust gas flow. In another embodiment, it is principally possible to arrange the valve arrangement 2 downstream of the EGR cooler with respect to the exhaust gas flow. A cooling of the housing 6 can then be omitted.

The valves 9, 10, in particular with regard to FIG. 4, can be structured like a disk valve. For this, each valve 9, 10 comprises a valve disk 42 arranged such that its stroke is adjustable via a valve shaft 43 with respect to a valve seat 44. The valve seat 44 is formed here at a valve sleeve 45, which is also part of the respective valve 9, 10. The valve seat 44, together with the interacting valve disk 42, forms the intake side of the respective valve 9, 10. The discharge side of the respective valve 9, 10 is formed by a window 46, which is left open in the valve sleeve 45 of the respective valve 9, 10. Each of the valves 9, 10 hence comprise all components necessary for the functionality of the respective valve 9, 10. Thereby they can be preassembled and are independent of manufacturing tolerances of the housing 6. In particular, the valves 9, are formed such that they can be inserted in a completely assembled state into the housing 6. For this, according to FIG. 3, the housing 6 comprises a mounting side 47, through which the valves 9, 10 can be inserted into the housing 6. This mounting side 47 is equipped with a mounting flange 48, and, in the mounted state, is closed by a flange plate 49. The flange plate 49 is formed preferably complementary to the mounting flange 48. In the mounted state, according to FIG. 3, a seal 50 is arranged axially between the mounting flange 48 and the flange plate 49, to close the mounting side 47 tightly. The designation "axial" refers in this context to the mounting direction, thus to the insertion direction, in which the valves 9, 10 can be inserted into the housing 6.

According to FIGS. 3 and 4, the flange plate 49, together with the valves 9, 10 attached thereto, and together with the actuator drives 11, 12 attached thereto, form a unit 51, which can be completely preassembled. The mounting of the valve arrangement 2 is thereby considerably simplified. The flange plate 49 can consist of plastic. In particular, the flange plate 49 and the drive housing 20, 21 can be made of one piece.

Since in the valve arrangement 2 according to the invention, both valves 9, 10 are formed such, that they, in addition to the two end positions, open position and closed position, allow at least one, but preferably any number of intermediate positions, by means of the valves 9, 10, an exhaust gas recirculation rate, abbr. EGR rate, can be adjusted through the first gas path 7 as well as through the second gas path 6 independent from each other. Hence, the valve arrangement 2 allows, on the one hand, the adjustment of the EGR rate, and, on the other hand, the adjustment of the distribution of the recirculated exhaust gases to the two gas paths 7, 8. The distribution of the recirculated exhaust gases to the two gas paths 7, 8 determines finally the cooling of the recirculated exhaust gases, so that by means of the valve arrangement 2, in addition to the EGR rate, the exhaust gas cooling can be adjusted as well.

The invention claimed is:

1. A valve arrangement for an exhaust gas recirculation device of an internal combustion engine, comprising:

a first valve for controlling a first gas path, which is mobile between an open position, a closed position, and at least one intermediate position;

a second valve for controlling a second gas path separated from the first gas path, where the second valve is mobile independently from the first valve between an open position, a closed position, and at least one intermediate position;

a common housing, in which both the first and second valves are arranged, and through which the first and second gas paths are guided; and a coolant path configured in the housing and extending around at least a portion of at least one of the first and second valves.

2. The valve arrangement according to claim 1, wherein the housing comprises an inlet port connected with the coolant path and an outlet port connected with the coolant path.

3. The valve arrangement according to claim 2, wherein the housing is at least one of made of a metal based material, and that the housing is made of one piece.

4. The valve arrangement according to claim 2, wherein the housing comprises a mounting side, through which the valves are inserted into the housing, whereby the mounting side has a mounting flange and is at least one of the following:

i. the mounting flange is closed with a flange plate, and ii. that the flange plate with the valves attached thereto, and the actuator drives attached thereto for actuating of the valves, form a unit which is preassembled.

5. The valve arrangement according to claim 2, the housing of which is connected directly to an exhaust gas recirculation cooler by at least one of the inlet flange and the outlet flange.

6. The valve arrangement according to claim 2, wherein for actuating the first valve, a first actuator drive is provided, which is attached with a first drive housing at the common housing, and that for actuating the second valve, a second actuator drive is provided, which is attached with a second drive housing at the common housing.

7. The valve arrangement according to claim 1, wherein the housing is at least one of made of a metal based material, and that the housing is made of one piece.

8. The valve arrangement according to claim 7, the housing of which is connected directly to an exhaust gas recirculation cooler by at least one of the inlet flange and the outlet flange.

9. The valve arrangement according to claim 1, wherein for actuating the first valve, a first actuator drive is provided, which is attached with a first drive housing at the common housing, and that for actuating the second valve, a second actuator drive is provided, which is attached with a second drive housing at the common housing.

10. The valve arrangement according to claim 9, wherein the first drive housing and the second drive housing are made of a polymer.

11. The valve arrangement according to any one claim 1, wherein the housing comprises an inlet flange and an outlet flange by means of which the housing is integrated in the exhaust gas recirculation device, and between which the two gas paths extend.

12. The valve arrangement according to claim 11, wherein the housing comprises an inlet line which extends from the inlet flange to the inlet sides of the valves, and at least one of the following:

i. that the housing comprises an inlet partition which is arranged in the inlet line and which forms two separate inlet channels therein, whereby the first inlet channel is connected with the inlet side of the first valve, while the second inlet channel is connected with the inlet side of the second valve, and ii. that the inlet partition extending one of up to the inlet flange, into the inlet flange and projecting axially beyond the inlet flange.

13. The valve arrangement according to claim 12, wherein the housing is connected with the outlet flange to an exhaust gas recirculation cooler of the exhaust gas recirculation device, wherein the outlet partition, in a mounted state, projects so far into an inlet chamber of the exhaust gas recirculation cooler, that the outlet partition separates therein two inlet sub-chambers that are independent from each other, which are connected with cooling tubes of the exhaust gas recirculation cooler.

14. The valve arrangement according to claim 12, wherein the housing comprises an outlet line, which extends from the outlet flange to the outlet sides of the valves and at least one of the following:

i. that the housing comprises an outlet partition which is arranged in the outlet line and forms a first outlet channel and a second outlet channel that are separate, whereby the first outlet channel is connected with the outlet side of the first valve, while the second outlet channel is connected with the outlet side of the second valve, and ii. that the outlet partition is one of extending one of up to the outlet flange, extending into the outlet flange, and projecting axially beyond the outlet flange.

15. The valve arrangement according to claim 12, wherein the housing is connected with the inlet flange to an exhaust gas recirculation cooler of the exhaust gas recirculation device, wherein the inlet partition, in the mounted state, projects so far into an outlet chamber of the exhaust gas recirculation cooler that the inlet partition separates therein two outlet sub-chambers, which are connected with cooling tubes of the exhaust gas recirculation cooler.

16. The valve arrangement according to claim 11, wherein the housing comprises an outlet line, which extends from the outlet flange to the outlet sides of the valves, and at least one of the following:

i. that the housing comprises an outlet partition which is arranged in the outlet line and forms a first outlet channel and a second outlet channel that are separate, whereby the first outlet channel is connected with the outlet side of the first valve, while the second outlet channel is connected with the outlet side of the second valve, and ii. that the outlet partition extending one of up to the outlet flange, into the outlet flange and projecting axially beyond the outlet flange.

17. The valve arrangement according to claim 16, wherein the housing is connected with the outlet flange to an exhaust gas recirculation cooler of the exhaust gas recirculation device, wherein the outlet partition, in a mounted state, projects so far into an inlet chamber of the exhaust gas recirculation cooler, that the outlet partition separates therein two inlet sub-chambers that are independent from each other, which are connected with cooling tubes of the exhaust gas recirculation cooler.

18. The valve arrangement according to claim 16, wherein the housing is connected with the inlet flange to an exhaust gas recirculation cooler of the exhaust gas recirculation device, wherein the inlet partition, in the mounted state, projects so far into an outlet chamber of the exhaust gas recirculation cooler that the inlet partition separates therein two outlet sub-chambers, which are connected with cooling tubes of the exhaust gas recirculation cooler.

19. The valve arrangement according to claim 1, wherein the housing comprises a mounting side, through which the valves are inserted into the housing, whereby the mounting side has a mounting flange and is at least one of the following:

i. the mounting flange is closed with a flange plate, and ii. that the flange plate with the valves attached thereto, and the actuator drives attached thereto for actuating of the valves, form a unit which is preassembled.

20. The valve arrangement according to claim 1, the housing of which is connected directly to an exhaust gas recirculation cooler by at least one of the inlet flange and the outlet flange.

* * * * *